US005749512A

United States Patent [19]

Gingras-Taylor

[11] Patent Number: 5,749,512

[45] Date of Patent: May 12, 1998

[54] SELF-ADHESIVE CORNER REINFORCEMENT FOR CARDBOARD BOXES

[76] Inventor: Lynn Gingras-Taylor, 4041 - 17th Ave., Bettendorf, Iowa 52722

[21] Appl. No.: 563,160

[22] Filed: Nov. 27, 1995

[51] Int. Cl.[6] ..... B65D 5/50

[52] U.S. Cl. ..... 229/199; 206/459.5; 206/586; 206/813; 428/216

[58] Field of Search ..... 229/198.1, 198.3, 229/199; 206/459.5, 586, 813; 428/216

[56] References Cited

U.S. PATENT DOCUMENTS

| | | | |
|---|---|---|---|
| 2,376,660 | 5/1945 | Clark | 229/199 |
| 3,200,547 | 8/1965 | Johnson | 206/586 |
| 3,314,584 | 4/1967 | Knapp et al. | 206/586 |
| 3,355,081 | 11/1967 | Kachurchak | 229/199 |
| 3,368,736 | 2/1968 | McKellick | 229/199 |
| 3,511,464 | 5/1970 | Doll | 206/586 |
| 3,725,188 | 4/1973 | Kalt | 206/813 |
| 4,188,442 | 2/1980 | Asakura et al. | 428/216 |
| 5,181,611 | 1/1993 | Liebel | 206/586 |
| 5,217,774 | 6/1993 | Finrow | 229/199 |

OTHER PUBLICATIONS

The Wiley Encyclopedia of Packaging Technology, John Wiley and Sons, pp. 514–523, 1986.

*Primary Examiner*—Gary E. Elkins
*Attorney, Agent, or Firm*—Henderson & Sturm

[57] ABSTRACT

A thin, pliable, self-adhesive corner reinforcement for cardboard boxes. Two adjacent side panels are pivotally connected by a narrow vertical crease which affords a bending capability without fracture. Each of the side panels is pivotally connected to a base flap by a narrow horizontal crease extending the width of each side panel to allow a non-fracturing bending capability. The outer and inner edges of the base flaps are trimmed directionally toward each other to form a triangular shape while the apex of each triangle is bevelled and the corner formed at the right angle in the outer upper quadrant of each side panel is also bevelled. An adhesive covers the reinforcement in its entirety on one side. A peel-off strip covers the adhesive to prevent premature adhesion and has cut lines at the vertical and horizontal creases of the reinforcement to facilitate singular removal and ease of application.

2 Claims, 3 Drawing Sheets

SELF-ADHESIVE CORNER REINFORCEMENT FOR CARDBOARD BOXES

TECHNICAL FIELD

This invention relates to cardboard boxes, and more specifically to corner reinforcements for improving the wear threshold of cardboard box corners.

BACKGROUND OF THE INVENTION

Traditionally, cardboard box corners have been reinforced by the manufacturer's application of paper tape which wraps around the box corner and is secured by a marginal attachment from the corner edge to the adjacent sides which form that corner. Another method employed by the cardboard box manufacturer has been to blanket the entire bottom and/or top of the box with a single sheet of paper, which is folded over the box edge by a marginal degree and secured by an adhesive means to the inside of the box.

These two general methods of box corner reinforcements, although viable for a limited period of time, nevertheless suffer from a number of disadvantages:

a) The paper corner cover wears through from repeated use of the box, tearing and/or peeling at the corner.

b) Neither solution to covering cardboard box corners lends any appreciable strength to the corner itself.

c) Paper corner coverings are environmentally unsound in that limited use and early deterioration are inherent in their design, resulting in the manufacture of unnecessary cardboard boxes and paper production.

d) The resultant uselessness of cardboard boxes due to the deterioration of their corners creates an economic burden to the consumer.

e) Previously, box corner reinforcements were commercially made and applied, creating a void in the areas of consumer selection and choice.

f) Limited stacking capability is a function of the lack of added strength supplied by paper corner reinforcements.

g) Poor stacking capability of paper reinforced box corners results in less constructive use of storage space.

h) New cardboard box corners are subject to early deterioration due to weak paper reinforcements.

i) Once cardboard box corners have been crushed or torn apart, they can be shored up with different tape applications but no strength is added to the corner and eventually the tape will mimic the sagging shape of the corner.

Possibly, manufacturers of cardboard boxes felt it was cost-prohibitive in terms of time and materials to invest in boxes whose value is negligible once the product has been used up. However, due to environmental and economic considerations, a product which extends the life of a cardboard box, thus enhancing its usability, creates a valuable alternative to the consumer.

Disclosure of the Invention

The present invention discloses a cardboard box corner reinforcement made of high-density polyethylene which is able to withstand the wear and tear of repeated box usage thus increasing the life span and usefulness of the box.

Accordingly, several objects and advantages of the present invention are:

a) to provide a box corner reinforcement that can withstand the wear and tear associated with repeated use of a cardboard box;

b) to provide a box corner reinforcement which is a source of added strength to the box corner itself;

c) to provide an environmentally sound box corner reinforcement which is durable enough to withstand unlimited use without any appreciable deterioration thereby extending box life and reducing the need for excessive manufacture of cardboard boxes and paper;

d) to provide a box corner reinforcement, the durability of which will help relieve the economic burden faced by the consumer;

e) to provide a box corner reinforcement that is consumer applicable and available in multiple colors, providing the consumer with a selection and an alternative to present methods of box corner reinforcement;

f) to provide a box corner reinforcement, the strength of which will result in added stacking capability;

g) to provide a box corner reinforcement, the strength and durability of which will result in superior stacking capability and thus constructive use of storage space;

h) to provide a box corner reinforcement that fits between the lid and bottom of a new box (such as some game and stationary boxes) to prevent deterioration before it begins; and i) to provide a box corner reinforcement that not only reinforces torn, sagging or crushed box corners but in its application provides a new corner with the firmness, strength and durability to prevent a recurrence of past deterioration.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
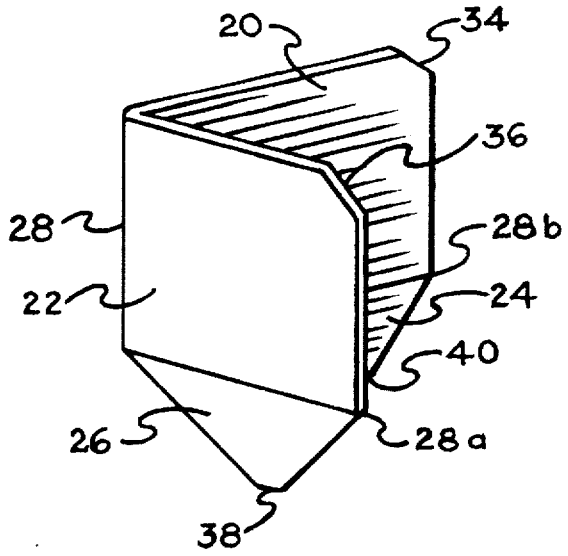
FIG. 1 is a perspective view of a partially folded cardboard box corner reinforcement in accordance with the present invention.
Figure 2:
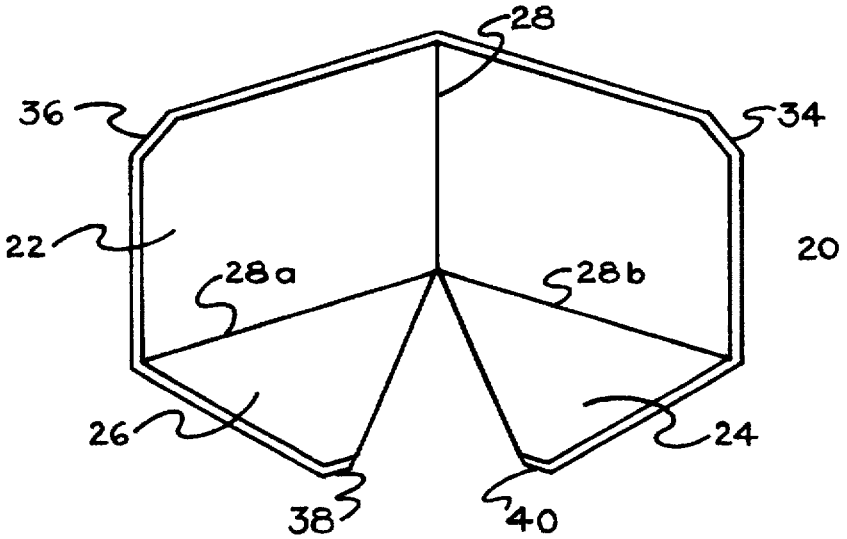
FIG. 2 is an elevated inside perspective of the device of FIG. 1.
Figure 3:
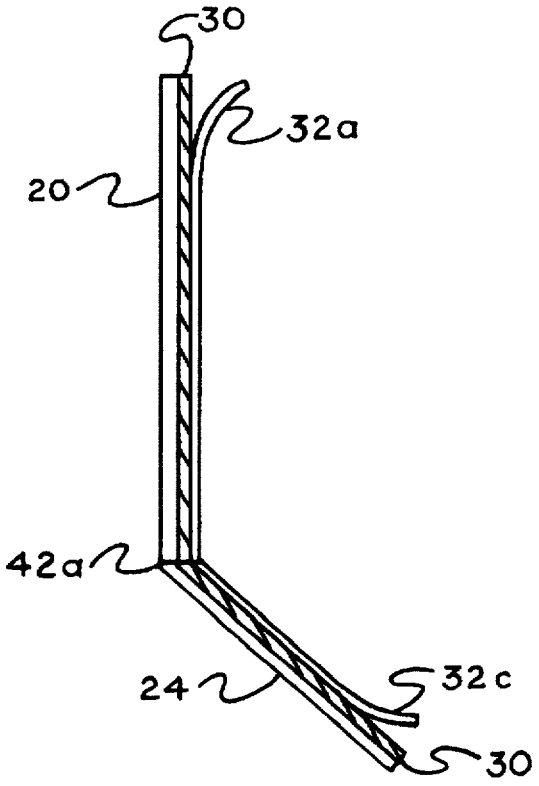
FIG. 3 is a cross-sectional view of the device of FIG. 1.
Figure 4:
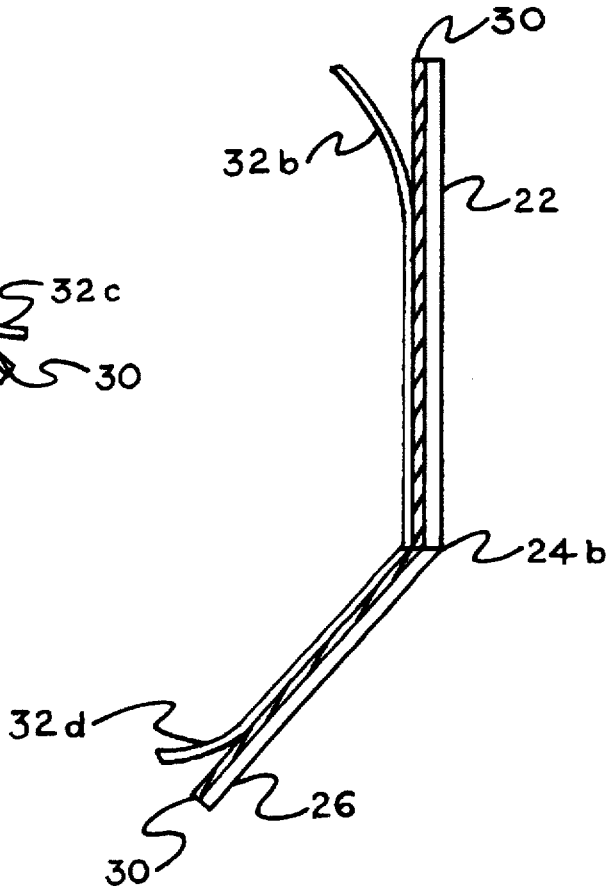
FIG. 4 is a cross-sectional view of a side panel and adjacent base flap of the device of FIG. 1.

A typical embodiment of the box corner reinforcement of the present invention is illustrated in FIG. 1 and FIG. 2. The box corner reinforcement comprises two side panels 20, 22 which can bend inward towards each other at a crease 28. Side panel 20 extends downward to form a bottom flap 24 which can bend upward and shares a common crease **28*b* with the side panel 20. The adjacent side panel 22 extends downward to form a bottom flap 26, both sharing a common crease 28*a***.

The corners 34, 36 formed at the upper outer quadrant of each side panel 20, 22 and the points 38, 40 formed at the apex of bottom flaps 24, 26 are typically bevelled to prevent snagging and personal injury.

Figure 5:
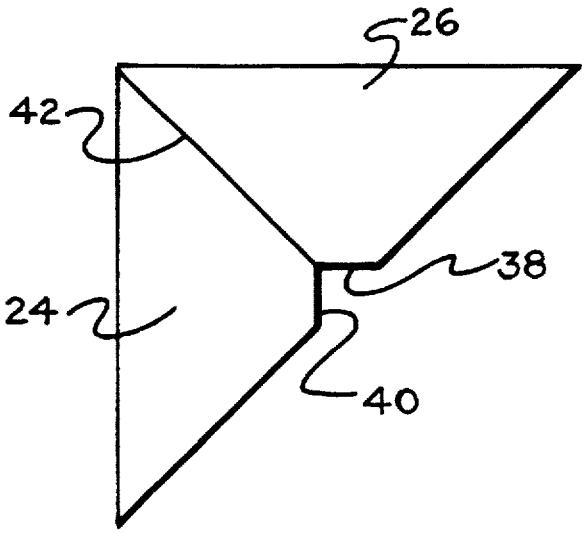
FIG. 5 is a bottom view of the device of FIG. 1 after the application.
Figure 6:
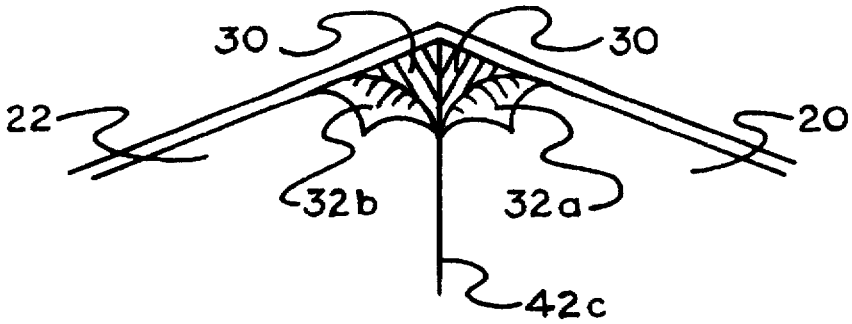
FIG. 6 is a cut-away view of a box corner reinforcement corner angle exhibiting a cut line of peel-off protective strips covering self-adhesive means.

The inner sides of the bottom flaps 24, 26 are typically cut at outward angles of 45 degrees so that application of the flaps 24, 26 to the appropriate area of the box corner to be reinforced results in a faultless seam 42 (FIG. 5). The outer sides of the bottom flaps 24,26 are typically cut at an inward angle of 45 degrees to create a surface area not overly large yet covering enough area to afford a secure adhesion to the box and present an aesthetically pleasing appearance upon application.

A color agent or plurality of color agents may be employed in the material forming the side panels 20, 22 and the flaps 24,26.

Additional embodiments are shown in FIGS. 3–6. A self-adhesive means 30 forms a covering over the entirety of the inside of the inwardly folding side panels 20, 22 and upwardly folding bottom flaps 24, 26. The self-adhering means is covered with a peel-off layer illustrated as partially peeled back in 32*a*, 32*b*, 32*c* and 32*d* respectively.

Application of the self-adhesive box reinforcement is as follows. Namely, the side panels 20, 22 should be folded inward at their adjoining crease 28 until the self-adhesive peel-off coverings are touching. The side panels 20, 22 should then be released to allow their natural separation.

One must then fold base flaps 24, 26 upward against corresponding side panels 20, 22 until self-adhesive peel-off coverings are touching. Applied pressure used to bend base flaps 24, 26 upward should then be released to allow natural separation between base flaps 24, 26 and corresponding side flaps 20, 22. After the initial folding of the various sections of the box corner reinforcement along its vertical crease 42*c* and horizontal creases 42*a* and 42*b*, the peel-off paper section 32*a* covering the self-adhesive means on the inner face of side panel 20 is removed. The same process is then repeated with the peel-off paper section 32*b* covering the self-adhesive means on the inner face of the adjacent side panel 22. The crease 28 is then aligned with the box corner edge to be reinforced. Pressure is applied at the corner crease 28 while reinforcement side panels 20, 22 are wrapped in unison around adjacent sides of the box, being careful to align the top edges of the reinforcement side panels 20, 22 to the open edge of the box corner to be reinforced. Removal of a peel-off self-adhesive cover strip 32*c* on a base flap 24 exposes the self-adhesive means and the base flap 24 is then pressed in a direction towards its adjacent side panel 20 until it contacts the box. Firm pressure is applied to secure base flap 24 to box. This procedure is repeated for the adjacent base flap 26.

Accordingly, the reader will see that the high-density polyethylene box corner reinforcement of this invention can be used easily and conveniently to reinforce new cardboard box corners or sagging, torn or crushed cardboard box corners. In addition it can be applied to corners of brand new boxes fitting easily between the box top and bottom and preventing deterioration before it begins.

Furthermore, high density polyethylene has the additional advantages in that

- it can be used to strengthen and renew sagging, torn or crushed cardboard box corners;
- it can be applied to corners of brand new cardboard boxes, fitting easily between the box top and bottom to prevent deterioration before it begins;
- it affords a variety of color choices, allowing consumer selection based on personal taste;
- its availability in a variety of colors allows color coding of cardboard boxes to facilitate selection of box with desired contents by non-readers;
- its durability results in the extension of the life of a cardboard box thereby creating an economic gain to the consumer;
- it can be produced from recycled plastics, thereby creating an environmental advantage;
- its strength and firmness results in stacking capacity previously unattainable.

Although the description above contains many specifications, these should not be construed as limiting the scope of the invention but as merely providing illustrations of some of the presently preferred embodiments of this invention. For example, the side panels do not have to be applied in unison. The application can occur one side at a time, beginning with either panel; the base flaps can be applied at the same time if the applicator so chooses; the bevelled corners and apexes could be rounded or ellipsoidal, etc.

Thus the scope of the invention should be determined by the appended claims and their legal equivalents, rather than by the examples given.

I claim:

1. A corner reinforcement for a cardboard box, comprising:

a sheet of resilient material having first and second side panels pivotally connected along a vertical hingeline and having first and second base flaps pivotally connected to said first and second side panels along first and second horizontal hingelines, wherein said side panels and said base flaps further comprise a layer of adhesive for securement to the cardboard box, and wherein said side panels are substantially rectangular in shape and said base flaps are substantially ninety degree isosceles triangles.

2. The corner reinforcement as recited in claim 1 wherein said side panels and said base flaps further comprise a plurality of color coding agents.

* * * * *